US012089752B2

(12) United States Patent
Wang et al.

(10) Patent No.: US 12,089,752 B2
(45) Date of Patent: Sep. 17, 2024

(54) ELASTIC BASE STRUCTURE AND UPHOLSTERED FURNITURE THEREWITH

(71) Applicant: Nisco Co., Ltd, Jiangsu (CN)

(72) Inventors: Wei Wang, Jiangsu (CN); Fahuan Zhang, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 136 days.

(21) Appl. No.: 17/897,323

(22) Filed: Aug. 29, 2022

(65) Prior Publication Data

US 2023/0065375 A1 Mar. 2, 2023

(30) Foreign Application Priority Data

Aug. 30, 2021 (CN) ..... 202122058762.5

(51) Int. Cl.

| | |
|---|---|
| ***A47C 7/00*** | (2006.01) |
| ***A47C 7/02*** | (2006.01) |
| ***A47C 7/30*** | (2006.01) |
| ***A47C 7/35*** | (2006.01) |
| ***A47C 17/86*** | (2006.01) |

(52) U.S. Cl.

CPC ..... *A47C 7/30* (2013.01); *A47C 17/86* (2013.01)

(58) Field of Classification Search

CPC ..... A47C 7/30; A47C 17/86

See application file for complete search history.

(56) References Cited

U.S. PATENT DOCUMENTS

| | | | | | |
|---|---|---|---|---|---|
| 2,234,253 | A * | 3/1941 | Hopkes | A47C 7/35 | 267/102 |
| 2,685,328 | A * | 8/1954 | Hopkes, Jr. | A47C 7/28 | 267/88 |
| 3,323,183 | A * | 6/1967 | Sterner | A47C 31/06 | 267/111 |
| 3,560,049 | A * | 2/1971 | Burton | A47C 17/02 | 297/452.52 |
| 3,971,082 | A * | 7/1976 | Crosby | A47C 31/06 | 5/260 |
| 4,029,303 | A * | 6/1977 | Quakenbush | A47C 31/06 | 5/260 |
| 4,136,410 | A * | 1/1979 | Vandenbark | A47C 7/32 | 297/452.52 |
| 4,636,006 | A * | 1/1987 | Kazaoka | B60N 2/72 | 297/452.52 |
| 4,682,763 | A * | 7/1987 | Kazaoka | B60N 2/72 | 297/452.52 |
| 4,886,250 | A * | 12/1989 | Lucas | A47C 7/35 | 267/89 |

(Continued)

*Primary Examiner* — Shin H Kim

(74) *Attorney, Agent, or Firm* — Locke Lord LLP; Tim Tingkang Xia, Esq.

(57) ABSTRACT

An elastic base structure and a piece of upholstered furniture therewith. The elastic base structure includes a base frame comprising a pair of first support rods and a pair of second support rods connected to the pair of first support rod to form a square or rectangular structure; a plurality of serpentine springs; and a plurality of double-branched hook clips. Each serpentine spring has two oppose ends disconnectably connected to two double-branched hook clips that are in turn disconnectably connected to the pair of first support rods, respectively, such that the plurality of serpentine springs are parallel to each other.

13 Claims, 4 Drawing Sheets

(56) References Cited

U.S. PATENT DOCUMENTS

| | | | | |
|---|---|---|---|---|
| 5,538,325 | A * | 7/1996 | Bullard | A47C 7/30<br>297/440.22 |
| 6,170,915 | B1 * | 1/2001 | Weisz | A47C 7/35<br>297/452.52 |
| 7,438,362 | B2 * | 10/2008 | Dotta | A47C 7/28<br>297/452.52 |
| 7,794,021 | B2 * | 9/2010 | Sahashi | B60N 2/7094<br>297/452.52 |
| 2016/0174722 | A1 * | 6/2016 | Huang | A47C 1/023<br>297/383 |
| 2022/0078555 | A1 * | 3/2022 | Nelson | H04R 5/023 |
| 2023/0065375 | A1 * | 3/2023 | Wang | A47C 7/30 |

* cited by examiner

ELASTIC BASE STRUCTURE AND UPHOLSTERED FURNITURE THEREWITH

CROSS-REFERENCE TO RELATED PATENT APPLICATIONS

This application claims priority to and benefit of Chinese Patent Application Serial No. 202122058762.5, filed Aug. 30, 2021, which is incorporated herein in its entirety by reference.

FIELD OF THE INVENTION

The invention generally relates to furniture, and more particular to an elastic base structure and a piece of upholstered furniture such as a sofa having the elastic base structure.

BACKGROUND OF THE INVENTION

In daily life, the sofa is one of the most commonly used furniture. In order to increase the comfort and resilience, serpentine springs are generally installed on the sofa base. Usually, spring clips are fixed or welded on the sofa base and used to connect the serpentine springs to the sofa base. However, it is very difficult to install and replace the serpentine springs with the conventional spring clips. In addition, with the conventional spring clips, the ends of the serpentine springs may be easy to fall, especially when the serpentine springs are deformed, which may compromise the safety. Further, when the spring clips are damaged, a special tool and skill are needed to replace the damaged spring clips and/or the serpentine springs, which is time-consuming and laborious.

Therefore, a heretofore unaddressed need exists in the art to address the aforementioned deficiencies and inadequacies.

SUMMARY OF THE INVENTION

In view of the aforementioned deficiencies and inadequacies, one of the objectives of this invention is to provide an elastic base structure of furniture such as a sofa, which is convenient for installation and replacement of the serpentine spring, and makes the serpentine spring not easy to fall off.

In one aspect, the invention relates to elastic base structure for upholstered furniture, comprising a base frame comprising a pair of first support rods and a pair of second support rods connected to the pair of first support rod to form a square or rectangular structure; a plurality of serpentine springs; and a plurality of double-branched hook clips. Each serpentine spring has two oppose ends disconnectably connected to two double-branched hook clips that are in turn disconnectably connected to the pair of first support rods, respectively, such that the plurality of serpentine springs are parallel to each other.

In one embodiment, each of the two oppose end portions of each serpentine spring has a limit section that extends horizontally outward and is inclined towards the center of each serpentine spring.

In one embodiment, the limiting section is in an arc shape.

In one embodiment, the elastic base structure further comprises a plurality of spring limit rods fixedly connected to the base frame for limiting the serpentine springs from overstretching, wherein the plurality of spring limit rods are positioned below the serpentine springs such that the top of the spring limit rods and the bottom of the serpentine spring define a gap in the vertically direction.

In one embodiment, each of the pair of first support rods has a plurality of connection holes for receiving the double-branched hook clips, wherein each serpentine spring is disconnectably fixed to the first support rods by the double-branched hook clips received in the connection holes of the first support rods.

In one embodiment, each double-branched hook clip comprises an open-loop hook at its one end portion and two closed-loop hooks at its another end portion, wherein the open-loop hook has a V-shaped structure, and the two closed-loop hooks and the open-loop hook forms a Y-shaped structure, and wherein as assembled, the open-loop hook is connected to a connection hole of the first support rods, and an end of a serpentine spring passes through the two closed-loop hooks so as to connect the serpentine spring to the first support rods.

In one embodiment, the elastic base structure is a spring suspension system for support of cushions of the upholstered furniture.

In one embodiment, the upholstered furniture is a sofa, an armchair, or the like.

In another aspect, the invention relates to a piece of upholstered furniture, comprising an elastic base structure comprising a base frame, a plurality of serpentine springs, and a plurality of double-branched hook clips, wherein each serpentine spring has two oppose ends disconnectably connected to two double-branched hook clips that are in turn disconnectably connected to the base frame such that the plurality of serpentine springs are parallel to each other; a backrest arranged above a rear side of the base frame; two armrests symmetrically arranged on left and right sides of the base frame; and one or more support posts arranged at the bottom of the base frame.

In one embodiment, each of the two oppose end portions of each serpentine spring has a limit section that extends horizontally outward and is inclined towards the center of each serpentine spring.

In one embodiment, the limiting section is in an arc shape.

In one embodiment, the elastic base structure further comprises a plurality of spring limit rods fixedly connected to the base frame for limiting the serpentine springs from overstretching, wherein the plurality of spring limit rods are positioned below the serpentine springs such that the top of the spring limit rods and the bottom of the serpentine spring define a gap in the vertically direction.

In one embodiment, the base frame comprises a pair of first support rods and a pair of second support rods connected to the pair of first support rod to form a square or rectangular structure.

In one embodiment, each of the pair of first support rods has a plurality of connection holes for receiving the double-branched hook clips, wherein each serpentine spring is disconnectably fixed to the first support rods by the double-branched hook clips received in the connection holes of the first support rods.

In one embodiment, each double-branched hook clip comprises an open-loop hook at its one end portion and two closed-loop hooks at its another end portion, wherein the open-loop hook has a V-shaped structure, and the two closed-loop hooks and the open-loop hook forms a Y-shaped structure, and wherein as assembled, the open-loop hook is connected to a connection hole of the first support rods, and an end of a serpentine spring passes through the two closed-loop hooks so as to connect the serpentine spring to the first support rods.

In one embodiment, the elastic base structure is a spring suspension system for support of cushions of the upholstered furniture.

In one embodiment, the piece of upholstered furniture is a sofa, an armchair, or the like.

According to the invention, the elastic base structure has at least the following advantages:

(1) The elastic base structure realizes the convenient installation and replacement of the serpentine springs by using the double-branched hook clips. Even if some of the double-branched hook clips are damaged, they can be easily removed and replaced, and the two sides/ends of the serpentine springs are horizontally aligned, and extends toward a limited position/section, which effectively prevents the serpentine springs from falling or sagging, thereby improving the safety.

(2) The elastic base structure can effectively improve the overall stability of the serpentine spring and the comfort by using the double-branched hook clips with two closed-loop hooks.

(3) The elastic base structure effectively avoids the damage of the serpentine springs due to transitional stretching by using the spring limit rods under the serpentine springs.

(4) By using the limiting section in an arc shape, the elastic base structure not only effectively prevents falling or sagging, but also facilitates the connection between the serpentine springs and the double-branched hook clips.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

FIG. 5A: a perspective view; FIG. 5B: a side elevation view; and FIG. 5C: a top plan view.

DETAILED DESCRIPTION OF THE INVENTION

Figure 1:
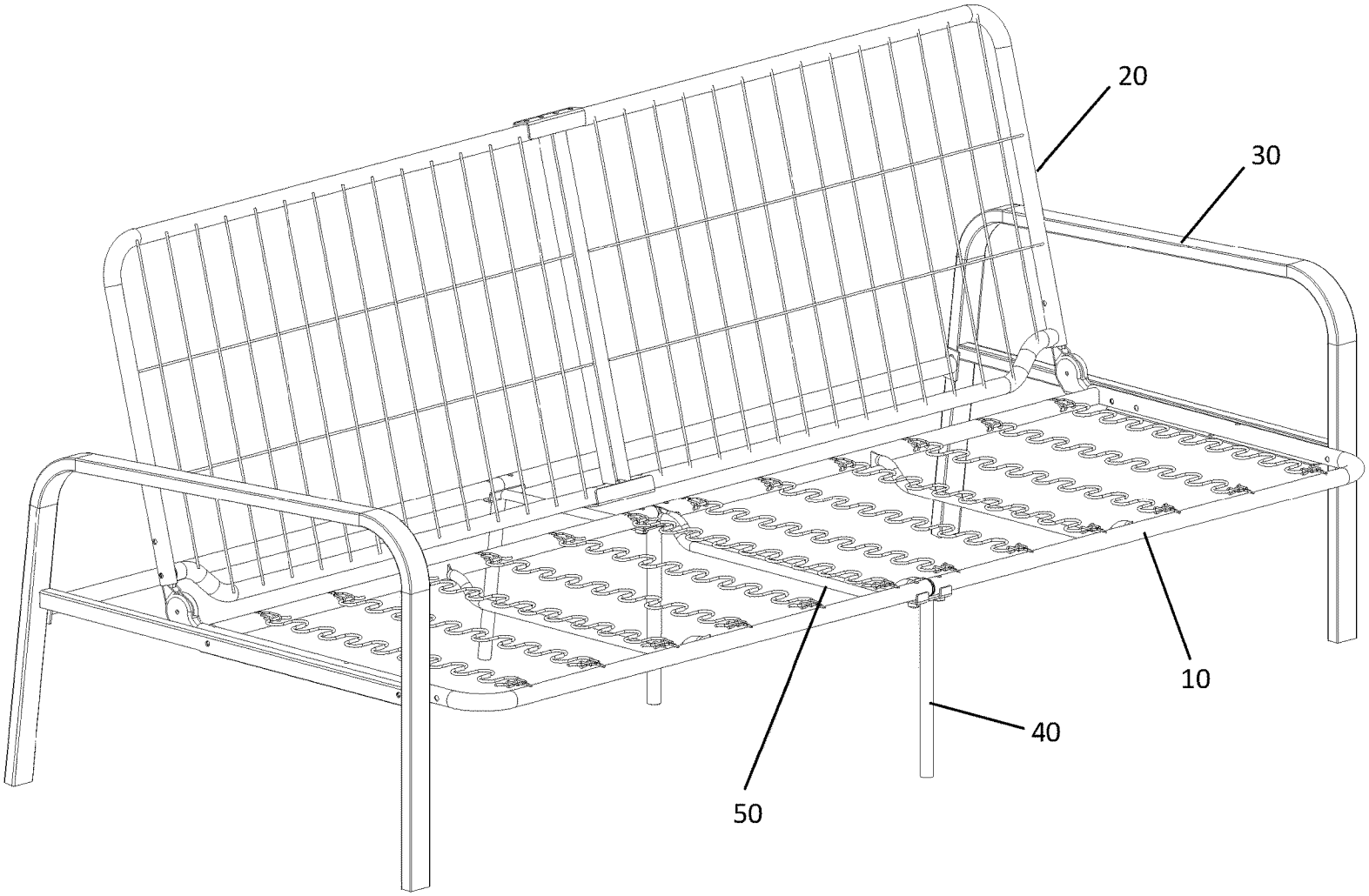
FIG. 1 shows schematically a sofa base with an elastic base structure according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

As used in this specification, the terms "serpentine spring", "no-sag spring", "zigzag spring", and "sinuous spring" are exchangeable and all refer to the same-type spring, but with different names.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-4 and 5A-5C. In accordance with the purposes of this invention, as embodied and broadly described herein, this invention, in one aspect, relates to an elastic base structure and a piece of upholstered furniture therewith.

As shown in FIG. 1, a piece of upholstered furniture such as a sofa is shown according to one embodiment of the invention. It should be appreciated that the upholstered furniture can be an armchair or the like. In the exemplary embodiment, the upholstered furniture such as a sofa includes an elastic base structure 10, a backrest 20 fixed on the rear side of the elastic base structure 10, two armrests 30 symmetrically fixed on two lateral (left and right) sides of the elastic base structure 10, and one or more support posts/bracket 40 arranged at the bottom of the elastic base structure 10.

For the purpose of concise descriptions, only is the elastic base structure 10 illustrated in details as follows. The elastic base structure 10 is a spring suspension system for support of cushions of the sofa.

Figure 2:
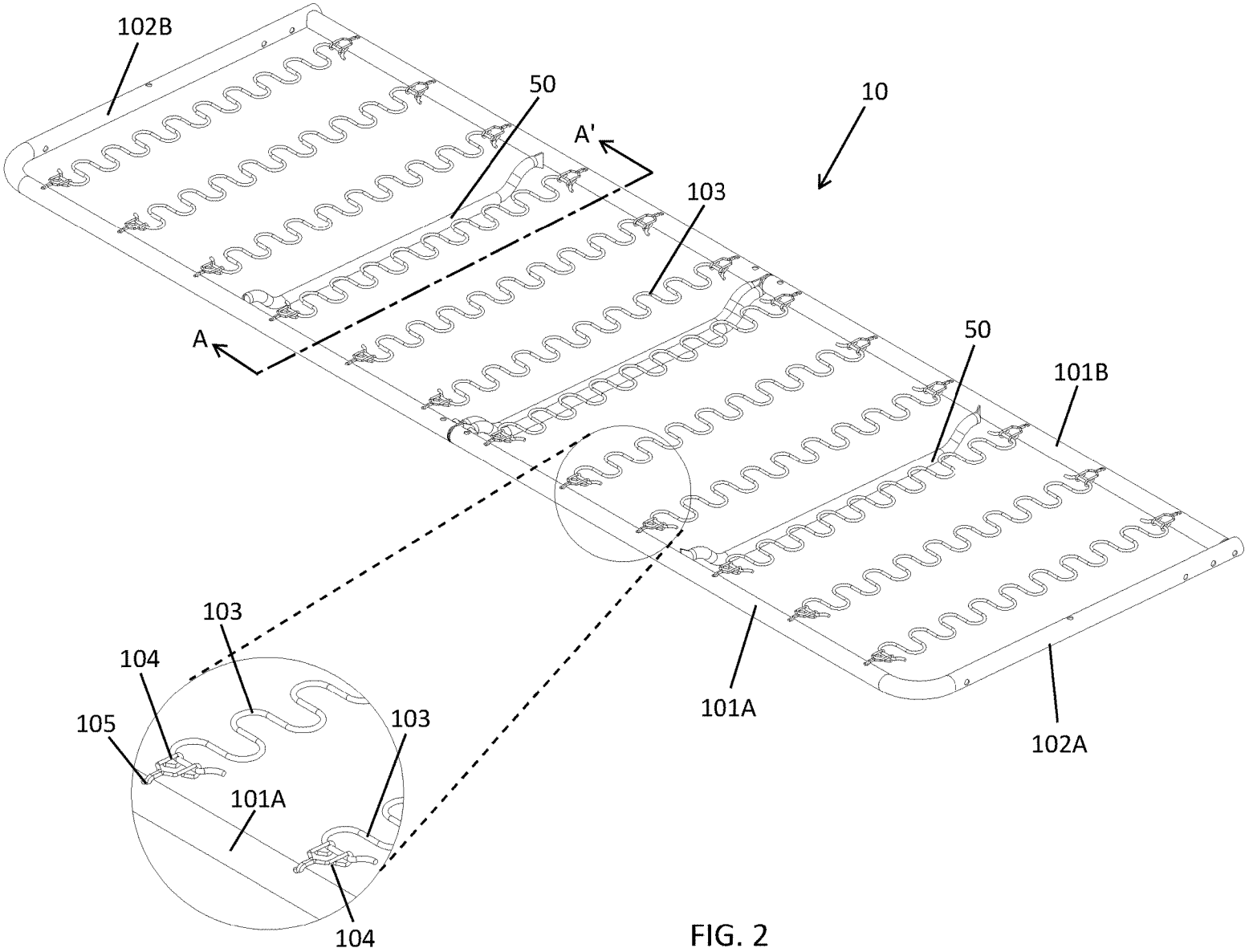
FIG. 2 shows the elastic base structure of FIG. 1.

Referring to FIGS. 2-4 and 5A-5C, and particularly to FIG. 2, the elastic base structure 10 comprises a base frame having a pair of first support rods 101A (front support rod) and 101B (rear support rod) and a pair of second support rods 102A (left support rod) and 102B (right support rod) connected to the front support rod 101A and the rear support rod 101B to form a square or rectangular structure. The base frame can be formed of wood, plastic, fiberglass, steel, aluminum, alloy, or the likes. Each of the pair of first support rods 101A and 101B and the pair of second support rods 102A and 102B can be a solid rod or a tube. The connections between the pair of first support rods 101A and 101B and the pair of second support rods 102A and 102B can be achieved by any fixed connection means such as welding means, molding means, screwing means, mating connections, or the likes.

The elastic base structure 10 also comprises a plurality of serpentine springs 103; and a plurality of double-branched hook clips 104. The serpentine springs 103 are used as the elastic foundation for sofa cushions. The serpentine springs 103 are made of high gauge steel, e.g., 9-gauge steel, alloy, or the like. The double-branched hook clips 104 are formed of steel or alloy.

Figure 4:
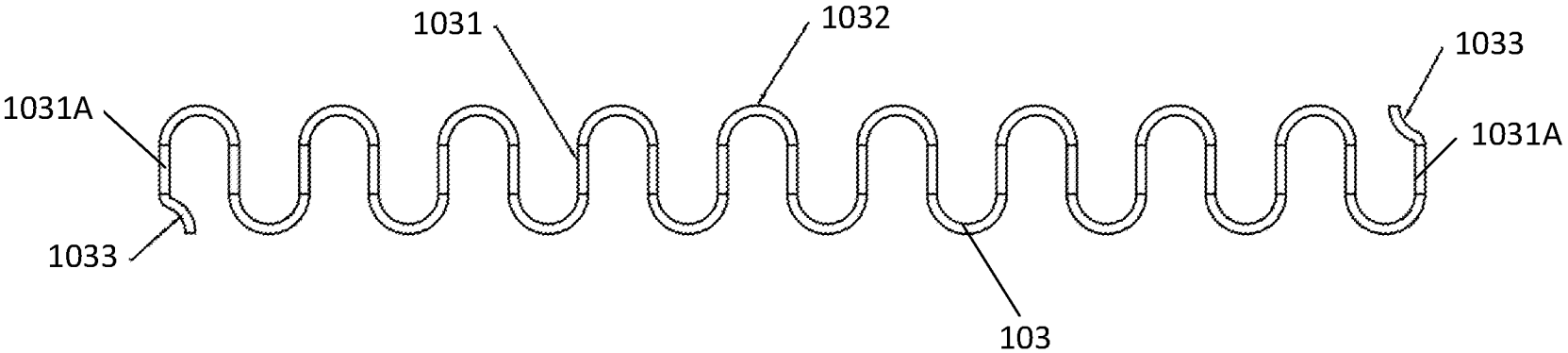
FIG. 4 shows a serpentine spring used in the elastic base structure of FIG. 2.

As shown in FIG. 4, each serpentine spring 103 is composed of a plurality of straight sections/segments 1031 and a plurality of curved sections/segments 1032 which are integrally formed. The straight sections 1031 and the curved sections 1032 are connected end to end to form a serpentine structure. Each of the two oppose end portions of each serpentine spring 103 is composed of a (first or last) straight segment 1031A and an arc segment 1033 that is extended horizontally outward from said straight segment 1031A. In the exemplary embodiment, the arc segment 1033 extends from the end (i.e., the connection point between the arc segment 1033 and said straight segment 1031A) of said straight segment 1031 and is inclined toward the center of the serpentine spring 103, which effectively prevents the serpentine spring 103 from falling and improves the safety factor. The arc segment 1033 is also called as a limit section.

Figure 5A:
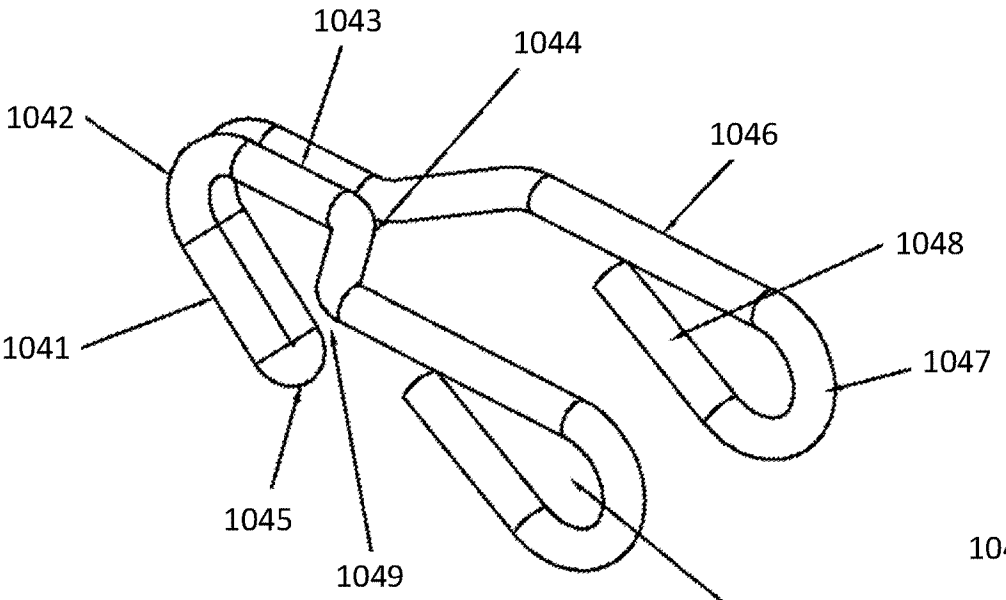
FIGS. 5A-5C show a double-branched hook clip used in the elastic base structure of FIG. 2.
Figure 5B:
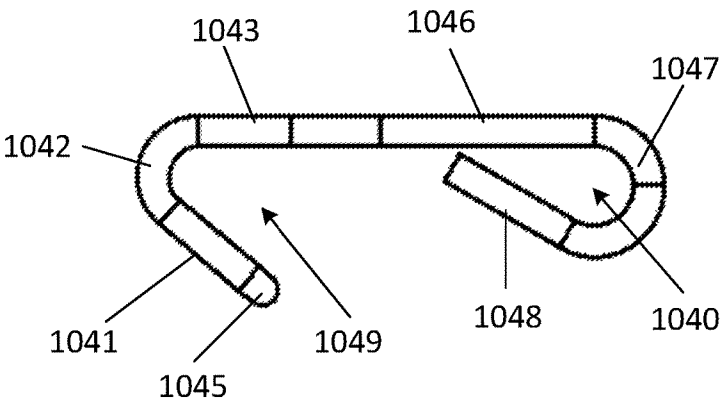
Figure 5C:
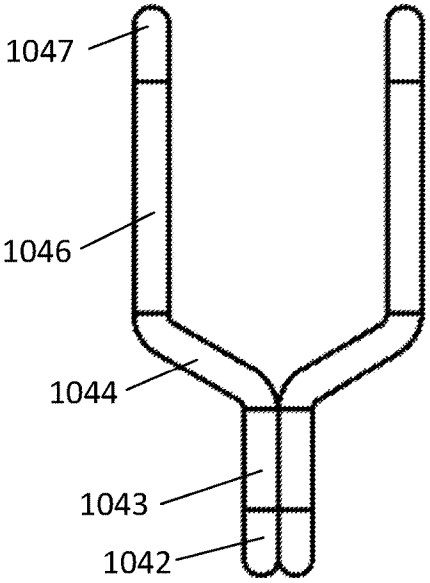

As shown in FIGS. 5A-5C, the double-branched hook clip 104 includes a first branch and a second branch forming an open-loop hook at one end thereof and two closed-loop hooks at another end thereof. The first branch and the second branch are structurally the same.

Each of the first branch and the second branch includes a first straight segment 1041, a first curved segment 1042 extended from first straight segment 1041, a second straight segment 1043 extended from the first curved segment 1042, an inclined segment 1044 extended from the second straight segment 1043, a third straight segment 1046 extended from the inclined segment 1044, a second curved segment 1047 extended from the third straight segment 1046, and a fourth straight segment 1048 extended from the second curved segment 1047. Both free ends of the first straight segments 1041 of the first branch and the second branch are connected by a curved segment 1045.

The first straight segment 1041, the first curved segment 1042 and the second straight segment 1043 of the second branch and that of the first branch are respectively fittingly arranged, and together with the curved segment 1045, define the open-loop hook having a V-shaped structure with an opening 1049, where the first straight segment 1041 is positioned below the second straight segment 1043, as shown in FIGS. 5A-5B.

The first branch and the second branch are separated from the inclined segment 1044, and the remaining segments of each branch: the third straight segment 1046, the second curved segment 1047 and the fourth straight segment 1048 define a closed-loop hook, where the fourth straight segment 1048 is positioned below the third straight shaft section 1046, the free end of the fourth straight segment 1048 is in contact with or close to the bottom of the third straight segment 1046 to form a through hole 1040 for the serpentine spring 103 to pass through.

As shown in FIG. 5C, the first branch and the second branch separated from the inclined segment 1044 define a Y-shaped structure, which can effectively improve the overall stability of the serpentine spring and improve the comfort by setting two closed-loop hooks.

As assembled, both end portions of each serpentine spring 103 are disconnectably connected to two double-branched hook clips 104 through the through holes 1040 thereof. The double-branched hook clips 104 are in turn disconnectably connected to the pair of first support rods 101A and 101B, respectively, by hooking the open-loop hooks in the connecting holes 105 defined in the pair of first support rods 101A and 101B. The plurality of serpentine springs 103 are parallel to each other.

Figure 3:
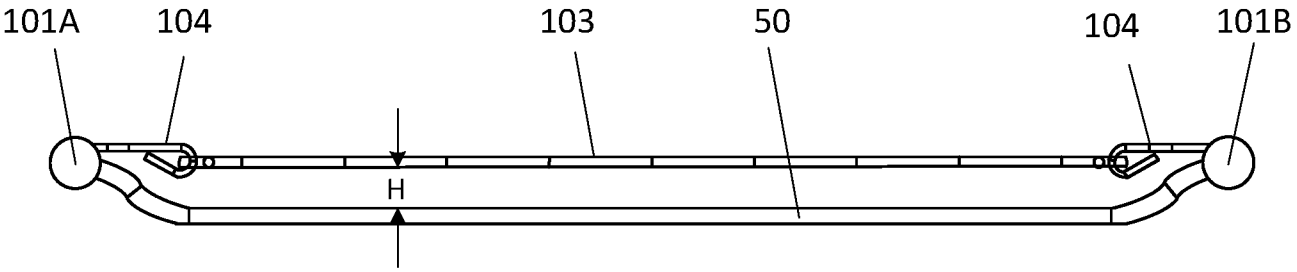
FIG. 3 shows a cross sectional view of the elastic base structure of FIG. 2, along section A-A'.

As shown in FIGS. 2-3, the elastic base structure 10 also includes a plurality of spring limit rods 50 fixedly connected to the pair of first support rods 101A and 101B for limiting the serpentine springs 103 from overstretching or sagging, thereby effectively avoiding the damage of the serpentine spring transitional stretching. In the exemplary embodiment, the spring limit rods 50 are positioned below the serpentine springs 103 such that the top of the spring limit rods 50 and the bottom of the serpentine spring 103 define a gap, H, in the vertically direction, as shown in FIG. 3. It should be noted that the plurality of spring limit rods 50 may be fixedly connected to the pair of second support rods 102A and 102B.

In sum, by utilizing the double-branched hook clips, the serpentine springs are easy to install and replace. Even if some of the double-branched hook clips are damaged, they can be easily removed for replacement. In addition, the serpentine springs have the arc limit sections extending along both end portions thereof, which can effectively prevent the serpentine springs from falling, thereby improving the safety factor.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An elastic base structure for upholstered furniture, comprising:

a base frame comprising a pair of first support rods and a pair of second support rods connected to the pair of first support rod to form a square or rectangular structure;

a plurality of serpentine springs; and a plurality of double-branched hook clips, wherein each serpentine spring has two oppose end portions disconnectably connected to two double-branched hook clips that are in turn disconnectably connected to the pair of first support rods, respectively, such that the plurality of serpentine springs are parallel to each other;

wherein each of the pair of first support rods has a plurality of connection holes for receiving the double-branched hook clips, wherein each serpentine spring is disconnectably fixed to the first support rods by the double-branched hook clips received in the connection holes of the first support rods; and wherein each double-branched hook clip comprises an open-loop hook at its one end portion and two closed-loop hooks at another end portion, wherein the open-loop hook has a V-shaped structure, and the two closed-loop hooks and the open-loop hook forms a Y-shaped structure, and wherein as assembled, the open-loop hook is connected to a connection hole of the first support rods, and an end of a serpentine spring passes through the two closed-loop hooks so as to connect the serpentine spring to the first support rods.

2. The elastic base structure of claim 1, wherein each of the two oppose end portions of each serpentine spring has a limit section that extends horizontally outward and is inclined towards the center of each serpentine spring.

3. The elastic base structure of claim 2, wherein the limiting section is in an arc shape.

4. The elastic base structure of claim 1, further comprising a plurality of spring limit rods fixedly connected to the base frame for limiting the serpentine springs from overstretching, wherein the plurality of spring limit rods are positioned below the serpentine springs such that the top of the spring limit rods and the bottom of the serpentine spring define a gap in the vertically direction.

5. The elastic base structure of claim 1, being a spring suspension system for support of cushions of the upholstered furniture.

6. The elastic base structure of claim 1, wherein the upholstered furniture is a sofa, an armchair, or the like.

7. A piece of upholstered furniture, comprising:

an elastic base structure comprising a base frame, a plurality of serpentine springs, and a plurality of double-branched hook clips, wherein each serpentine spring has two oppose ends disconnectably connected to two double-branched hook clips that are in turn disconnectably connected to the base frame such that the plurality of serpentine springs are parallel to each other, wherein the base frame comprises a pair of first support rods and a pair of second support rods connected to the pair of first support rod to form a square or rectangular structure;

wherein each of the pair of first support rods has a plurality of connection holes for receiving the double-branched hook clips, wherein each serpentine spring is disconnectably fixed to the first support rods by the double-branched hook clips received in the connection holes of the first support rods; and wherein each double-branched hook clip comprises an open-loop hook at its one end portion and two closed-loop hooks at its another end portion, wherein the open-loop hook has a V-shaped structure, and the two closed-loop hooks and the open-loop hook forms a Y-shaped structure, and wherein as assembled, the open-loop hook is connected to a connection hole of the first support rods, and an end of a serpentine spring passes through the two closed-loop hooks so as to connect the serpentine spring to the first support rods.

8. The piece of upholstered furniture of claim 7, wherein each of the two oppose end portions of each serpentine spring has a limit section that extends horizontally outward and is inclined towards the center of each serpentine spring.

9. The piece of upholstered furniture of claim 7, wherein the limiting section is in an arc shape.

10. The piece of upholstered furniture of claim 7, wherein the elastic base structure further comprises a plurality of spring limit rods fixedly connected to the base frame for limiting the serpentine springs from overstretching, wherein the plurality of spring limit rods are positioned below the serpentine springs such that the top of the spring limit rods and the bottom of the serpentine spring define a gap in the vertically direction.

11. The piece of upholstered furniture of claim 7, wherein the elastic base structure is a spring suspension system for support of cushions of the upholstered furniture.

12. The piece of upholstered furniture of claim 7, being a sofa, an armchair, or the like.

13. The piece of upholstered furniture of claim 7, further comprising:

a backrest arranged above a rear side of the base frame;

two armrests symmetrically arranged on left and right sides of the base frame; and one or more support posts arranged at the bottom of the base frame.

* * * * *